US005495733A

United States Patent [19]

Yen et al.

[11] Patent Number: 5,495,733

[45] Date of Patent: Mar. 5, 1996

[54] LOCK FOR A SAFE-DEPOSIT BOX

[76] Inventors: Chieh-Cheng Yen, No. 9, Lane 37, Sec. 1, Chang-An E. Rd.; Wen-Tung Chien, 3Fl., No. 2-2, Lane 178, Chingnien Rd., both of Taipei, Taiwan

[21] Appl. No.: 322,074

[22] Filed: Oct. 12, 1994

[51] Int. Cl.[6] ..... E05B 47/00; E05B 25/00

[52] U.S. Cl. ..... 70/279; 70/337; 70/355; 70/377; 70/284

[58] Field of Search ..... 70/279, 355, 277, 70/284, 285, 278, 337, 338, 377

[56] References Cited

U.S. PATENT DOCUMENTS

| | | | |
|---|---|---|---|
| 1,561,207 | 11/1925 | Benham | 70/385 |
| 2,524,696 | 10/1950 | Ellis | 70/355 |
| 3,978,700 | 9/1976 | Glass | 70/339 |
| 4,290,287 | 9/1981 | Peppard | 70/355 |
| 4,332,153 | 6/1982 | Miles | 70/339 |
| 4,807,455 | 2/1989 | Mauer | 70/277 |

*Primary Examiner*—Steven N. Meyers
*Assistant Examiner*—Jay Lecher
*Attorney, Agent, or Firm*—Poms, Smith, Lande & Rose

[57] ABSTRACT

A safe-deposit box uses a lock using a tongue, a first mechanical device, a second mechanical device, an electromagnetic valve, a control unit and a keypad. A renter's key drives the first mechanical device from a first position to a second position for actuating the control unit. The electromagnetic valve is in a first position for retaining the first mechanical device in the second position. A code is input through the keypad to the control unit for driving the electromagnetic valve from the first position to a second position for allowing movement of the mechanical device from the second position to a third position for retracting the tongue. A clerk's key can drive the second mechanical device from a first position to a second position for driving the electromagnetic valve from the first position to the second position and turning off the control unit. If the code is forgotten, the second mechanical device is driven from the second position back to the first position for retaining the electromagnetic valve in the second position for allowing the movement of the first mechanical device from the first position to the third position. If the renter fails to pay rent for the safe, the second mechanical device is driven from the second position through the first position to a third position for driving the electromagnetic valve back to the first position for preventing the movement of the first mechanical device from the first position to the third position.

20 Claims, 7 Drawing Sheets

LOCK FOR A SAFE-DEPOSIT BOX

BACKGROUND OF THE INVENTION

This invention relates to a lock. More particularly, this invention relates to a lock incorporated with a safe-deposit box.

Clients (renters) rent safe-deposit boxes from banks for storing valuable items such as jewelry or documents. Each of the conventional safe-deposit boxes defines a first keyhole and a second keyhole. A first key kept by a safe-deposit box renter has to be inserted in the first keyhole and a second key kept by a bank official has to be inserted in the second keyhole in order to unlock the safe-deposit box. Each renter must be identified before he/she can have a bank official open the lock together with him/her. Very possibly, many clients want to unlock their rent safe-deposit boxes in a hurry. However, there may be insufficient bank officials to simultaneously deal with so many renters. Therefore, some of the renters have to wait for an available bank official.

To solve the above-mentioned problem, the inventor has devised a lock which includes a keyhole defined therein and a keypad mounted thereon. A renter has to insert a key in the keyhole and enter a code through the keypad in order to unlock the safe-deposit box. Thus, a renter can open a safe-deposit box without requiring the attendance of a bank official. However, a bank is not able to keep a renter from unlocking the safe-deposit boxes when the renter fails to pay rent to the bank. Furthermore, it will be impossible for anyone to unlock such a safe-deposit box if a renter forgets the code or a power supply is interrupted. Moreover, the keypad and related electrical elements are always turned on, reducing the life of the lock. Furthermore, it will be impossible for anyone to unlock the safe-deposit box when the keypad malfunctions. This invention is intended to solve the above-mentioned problems.

SUMMARY OF THE INVENTION

The primary objective of this invention is to provide a lock for a safe-deposit box. The lock uses a tongue, a first mechanical device, a second mechanical device, an electromagnetic valve, a control unit and a keypad. A renter's key drives the first mechanical device from a first position to a second position for actuating the control unit. The electromagnetic valve is in a first position for retaining the first mechanical device in the second position. A code is input through the keypad to the control unit for driving the electromagnetic valve from the first position to a second position for allowing movement of the mechanical device from the second position to a third position for retracting the tongue. An official's key can drive the second mechanical device from a first position to a second position for driving the electromagnetic valve from the first position to the second position and turning off the control unit. If the code is forgotten, the second mechanical device is driven from the second position back to the first position for retaining the electromagnetic valve in the second position for allowing the movement of the first mechanical device from the first position to the third position. If the renter fails to pay rent for the safe-deposit box, the second mechanical device is driven from the second position through the first position to a third position for driving the electromagnetic valve back to the first position for preventing the movement of the first mechanical device from the first position to the third position.

The primary objective of this invention is achieved by providing a lock including a case defining an aperture and a slot. A first latch includes a tab projecting therefrom, a mandrel-pushing element projecting therefrom, an aperture defined therein and a recess defined therein. The first latch is slidably receivable in the case. A ring includes a lower shoulder formed thereon, an upper shoulder formed thereon and a tab formed on an edge. The ring is pivotably receivable in the aperture defined in the first latch while the tab formed on the ring is receivable in the recess defined in the first latch. A third latch includes a trigger-like element projecting therefrom. The third latch is slidably receivable in the case. A second latch includes a tongue projecting therefrom, a tab projecting therefrom, a cutout defined therein, thus forming an arched edge and a curved edge. The second latch is slidably receivable in the case while the tongue is insertable through the aperture defined in the case. A lever includes a first end and a second end. The lever is pivotably receivable in the case. An electromagnetic valve includes a mandrel projecting therefrom. The electromagnetic valve is receivable in the case while the mandrel is linked to the second end of the lever. A control unit includes a microswitch, a switch bar and a keypad operatively linked thereto. The control unit is operatively connected with the electromagnetic valve while the switch bar is insertable through the slot defined in the case. A latch-driving element includes an axle insertable through the ring, a link projecting from the axle and a dialing element projecting from the link. A renter's key is engageable with the latch-driving element and rotatable clockwise for engaging the link with the trigger-like element for driving the third latch for pressing the microswitch for actuating the control unit. After the control unit is actuated, a code can be input through the keypad to the control unit for driving the electromagnetic valve for retracting the mandrel into the electromagnetic valve for pivoting the lever, thus disengaging the first end of the lever from the tab formed on the third latch. After the tab of the third latch is released from the first end of the lever the link is further pivotable by means of the renter's key for engaging with the curved edge for retracting the tongue into the case. An official's key is engageable with the latch-driving element and pivotable counterclockwise for engaging the dialing element with the lower shoulder for pivoting the ring for driving the first latch because of the engagement of the tab formed on the ring with the recess defined in the first latch, so that the control unit is turned off as the switch bar is moved by means of the tab projecting from the first latch and that the tab projecting from the second latch is released from the first end of the lever as the lever is pivoted by means of the mandrel pushed by means of the mandrel-pushing element.

In another aspect, the official's key is pivotable clockwise for engaging the dialing element with the upper shoulder formed on the ring for pivoting the ring for driving the first latch for releasing the mandrel from the mandrel-pushing element in case that a renter fails to pay rent for a safe-deposit box-deposit box on which the lock is mounted.

In another aspect, the latch-driving element defines a groove in the axle and the link. A key is receivable in the groove defined therein.

In another aspect, the case includes an upper shaft projecting from a panel thereof, a lower shaft projecting from the panel thereof. The first latch defines an upper slot and a lower slot. The upper shaft formed on the case is insertable through the upper slot defined in the first latch and the lower shaft formed on the case is insertable through the lower slot defined in the first latch, so that the first latch is slidably receivable in the case.

In another aspect, the first latch includes a blade projecting therefrom. The second latch defines a slot, whereby the second latch is mounted on the blade projecting from the first latch and the lower shaft projecting formed on the case is insertable through the slot defined in the second latch, so that the second latch is slidably received in the case.

In another aspect, the third latch includes a blade projecting therefrom. The blade projecting from the third latch is mounted on the second latch and the third latch is mounted on the upper shaft formed on the case.

In another aspect, an upper group of key-engaging strips each include an arched lower edge and define a slot. The upper group of key-engaging strips are pivotably received in the case. Teeth of a renter's key are engageable with the lower edges of the upper group of key-engaging strips for aligning the slots defined in the upper group of key-engaging strips with one another for receiving the blade projecting from the third latch for allowing the movement of the third latch.

In another aspect, the upper group of key-engaging strips each define an aperture through which the upper shaft is insertable thus pivotably mounting the upper group of key-engaging strips on the upper shaft.

In another aspect, a lower group of key-engaging strips each include an arched upper edge and defining a slot. The lower group of key-engaging strips are pivotably received in the case. Teeth of an official's key are engageable with the upper edges of the lower group of key-engaging strips for aligning the slots defined in the lower group of key-engaging strips with one another for receiving the blade projecting from the first latch for allowing the movement of the first latch.

In another aspect, the lower group of key-engaging strips each define an aperture through which the lower shaft is insertable thus pivotably mounting the lower group of key-engaging strips on the lower shaft.

In another aspect, the case includes a hub-like element formed on a panel thereof. The axle is insertable in the hub-like element.

DETAILED DESCRIPTION OF THE PREFERRED EMBODIMENT

In this detailed description of the preferred embodiment, "front surface" refers to a surface facing a safe-deposit box renter or a bank official and "rear surface" refers to a surface behind the front surface.

Figure 1:
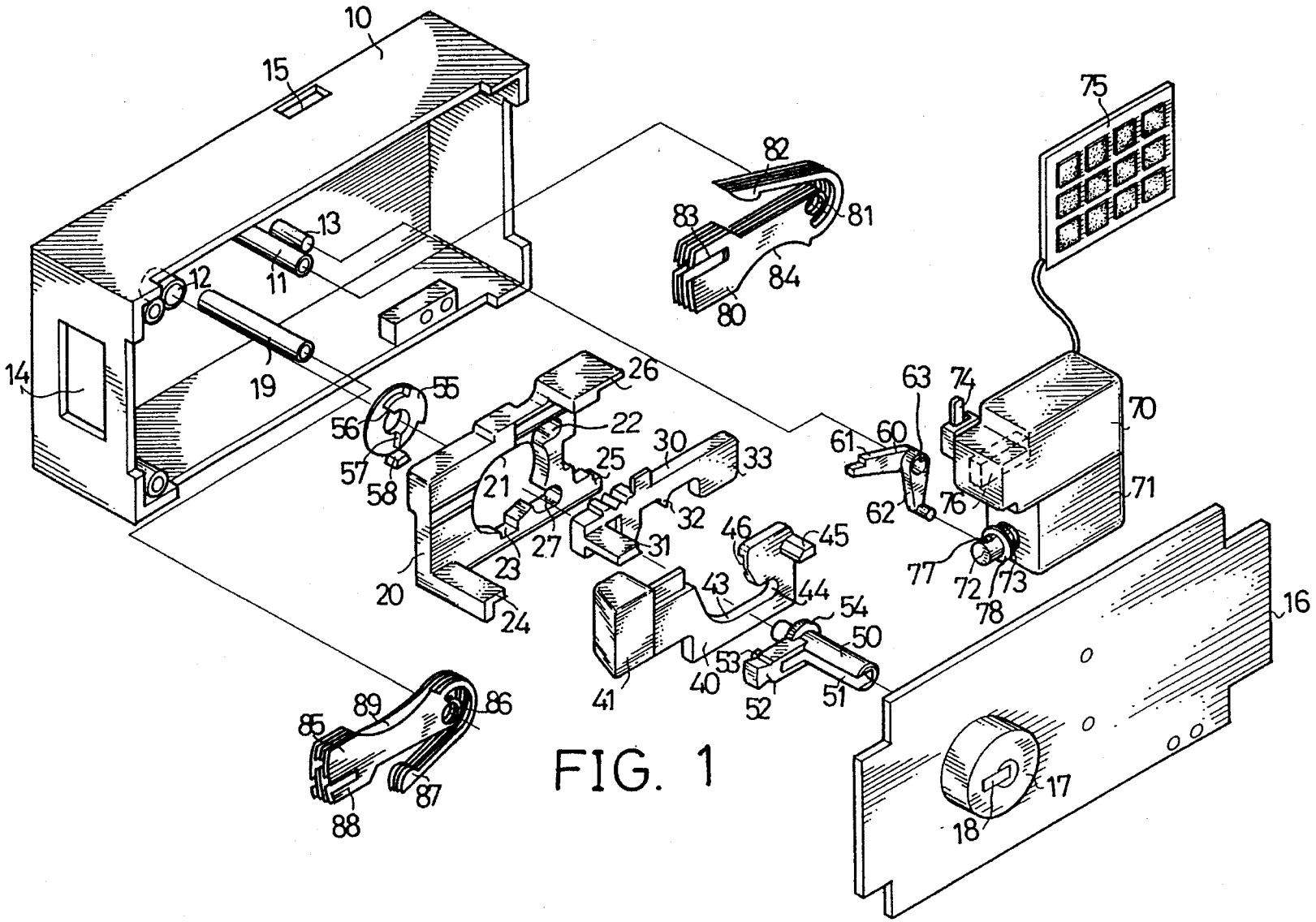
FIG. 1 is an exploded view of the preferred embodiment of a lock in accordance with this invention.

Referring to FIG. 1, a lock includes a case 10 and a cover 16. The box 10 includes a panel, an upper plate, a lower plate, a first side plate and a second side plate thus defining an opening sealable by means of the cover 16. The cover 16 is secured to the case 10 by appropriate means which will not be described in detail because it is well known. A plurality of elements (to be described) are enclosed in the case 10. A hollow protrusion 17 projects from a front surface of the cover 16. The hollow protrusion 17 is insertable through an aperture defined in a door of a safe-deposit box (not shown) when the case 10 and the cover 16 are mounted on a rear surface of the door of the safe-deposit box. The hollow protrusion 17 defines a keyhole 18 for through which a renter's key or an official's key is insertable.

The first side plate of the case 10 defines an aperture 14 through which a tongue 41 is insertable. The upper plate of the case 10 defines a slot 15 through which a switch bar 74 is insertable. An upper shaft 11, a lower shaft 19, a hub-like element 12 and a lever-bearing shaft 13 project horizontally from a front surface of the panel of the case 10. The shafts 11 and 16 are substantially located in a vertical line passing between the hub-like element 12 and the lever-bearing shaft 13.

A first latch 20 includes a flat body. A substantially oval aperture 21, an upper slot 22 and a lower slot 27 are defined horizontally in the flat body of the first latch 20. The upper shaft 11 is insertable through the upper slot 22, and the lower shaft 19 is insertable through the lower slot 27, so that the first latch 20 is slidably mounted on the panel of the case 10. The first latch 20 defines a recess 23. A blade 24 projects horizontally from a left lower corner of a front surface of the first latch 20. A mandrel-pushing element 25 projects horizontally from a right edge of the first latch 20 so that the first latch 20 and the mandrel-pushing element 25 are in a same plane. A tab 26 is formed on an upper edge of the first latch 20. The tab 26 extends beyond the right edge of the first latch 20.

A reversed C-shaped portion (not numbered) is formed on a front side of a ring 55. The reversed C-shaped portion includes two ends functioning as an upper shoulder 56 and a lower shoulder 57. A tab 58 is formed on the edge of the ring 55 near the lower shoulder 57. The ring 55 is receivable in the aperture 21. The tab 58 is receivable in the recess 23.

A second latch 40 includes a left-hand portion and a right-hand portion. The tongue 41 projects longitudinally from the left-hand portion of the second latch 40. The second latch 40 defines a cutout (not numbered) between the left-hand portion and the right-hand portion thus forming an arched edge 43 on the left-hand side of the cutout and a curved edge 46 on the right-hand side of the cutout. The second latch 40 defines a slot 44. A tab 45 projects horizontally from a front side of the second latch 40. The second latch 40 is disposed against the front surface of the first latch 20. The lower shaft 19 is insertable through the slot 44. A lower edge of the left-hand portion of the second latch 40 is slidably mounted on the blade 24. Thus, the second latch 40 is slidably received in the case 10.

A third latch 30 includes a left-hand end and a right-hand end functioning as a pushing end 33. A blade 31 projects horizontally from a front surface of the third latch 30 near the left-hand end. A trigger-like element 32 projects from a lower edge of the third latch 30. The third latch 30 is disposed against the front surface of the first latch 20. The blade 31 is slidably mounted on an upper edge of the left-hand portion of the second latch 40. The third latch 30 is slidably mounted on the upper shaft 11. Thus, the third latch 30 is slidably received in the case 10.

A latch-driving element (not numbered) includes an axle 50 including a front tip and a rear tip. An annular flange 54 is formed on the axle 50 near the rear tip. A link 52 projects radially from the axle 50 at the annular flange 54. A groove 51 is defined in the axle 50 and the link 52. A dialing portion 53 projects horizontally from a rear surface of the link 52. The rear tip of the axle 50 is insertable through the ring 55 into the hub-like element 12. Either of the renter's key or the official's key is insertable in the groove 51 so that the shaft link 52 is pivotable by pivoting either of the renter's key or the official's key. The dialing element 53 is engageable with the shoulder 56 so that the ring 55 is rotatable clockwise by pivoting the renter's key or the official's key clockwise. The dialing element 53 is engageable with the shoulder 57 so that the ring 55 is rotatable counterclockwise by pivoting the renter's key or the official's key counterclockwise.

A plurality of first key-engaging strips 80 each include an aperture 81 defined in a right-hand end, a slot 83 defined in a left-hand end, a tail-like element 82 projecting from the right-hand end thereof towards the left-hand end thereof and an arched lower edge 84 formed between the right-hand end and the left-hand end thereof. The slots 83 are so located that they are not aligned with one another when the arched edges 84 are aligned with one another.

The first key-engaging strips 80 are pivotably mounted on the upper shaft 11 by inserting the upper shaft 11 through the apertures 81. The first key-engaging strips 80 overlap one another. The tail-like elements 82 are disposed against the upper plate of the case 10 so as to bias the key-engaging strips 80 to a combination of positions so that the arched edges 84 are aligned with one another when the first key-engaging strips 80 are not in contact with the renter's key or the official's key. The slots 83 are not aligned with one another until the first key-engaging strips 80 are engaged with the renter's key or the official's key (more details will be given later). The blade 31 is receivable in the slots 83 when the slots 83 are aligned with one another (more details will be given later).

A plurality of second key-engaging strips 85 each include an aperture 86 defined in a right-hand end, a slot 88 defined in a left-hand end, a tail-like element 87 projecting from the right-hand end thereof towards the left-hand end thereof and an arched upper edge 89. The second key-engaging strips 85 are pivotably mounted on the lower shaft 19 by inserting the lower shaft 19 through the apertures 86. The slots 88 are so located that they are not aligned with one another when the arched edge 89 are aligned with one another.

The first key-engaging strips 80 are similar to the second key-engaging strips 85. The first key-engaging strips 80 can be inverted so as to make the second key-engaging strips 85.

The tail-like elements 87 are disposed against the lower plate of the case 10 so as to bias the second key-engaging strips 85 so that the arched edges 89 are aligned with one another when the second key-engaging strips 85 are not in contact with the renter's key or the official's key. The slots 88 are not aligned with one another until the second key-engaging strips 85 are engaged with the renter's key or the official's key (more details will be given later). The blade 24 is receivable in the slots 88 when the slots 88 are aligned with one another.

An angled lever 60 includes a middle portion, a first arm 61 projecting from the middle portion and a second arm 62 projecting from the middle portion. An aperture 63 is defined in the middle portion of the angled lever 60. The angled lever 60 is pivotably mounted on the lever-bearing shaft 13 by inserting the lever-bearing shaft 13 through the aperture 63. A protrusion 64 projects horizontally from a front surface of the second arm 62 near the tip.

The lock employs a lever-driving device (not numbered) including a control unit 70 and an electromagnetic valve 71 which are operatively connected with each other.

The electromagnetic valve 71 includes a mandrel 72 projecting therefrom. A recess 77 is defined transversely in the free end of the mandrel 72. The protrusion 64 is received in the recess 77 so that sliding of the mandrel 72 results in pivoting of the angled lever 60. An annular flange 78 is formed on the mandrel adjacent to the recess 77. A spring 73 is mounted on the mandrel 72. The spring 73 is compressed between the electrical valve 71 and the annular flange 78. When the lock electromagnetic valve 71 is turned off or the electricity supply fails, the spring 73 biases through the annular flange 78 the free end of the mandrel 72 from the electrical valve 71 so that the angled lever 60 is pivoted to a normal position for restraining the tongue 40 (more details thereof will be given later).

The control unit 70 includes a switch bar 74 corresponding to the tab 26, a keypad 75 operatively connected therewith by means of a cable (not numbered) and a microswitch 76 corresponding to the pushing end 33. The control unit 70 is disposed in the case 10. The switch bar 74 is insertable through the slot 15 so that the switch bar 74 can be operated without removing the cover 16. The keypad 75 is mounted on a front surface of the door of the safe-deposit box.

Although the renter's key and the official's key are not shown in the drawings, it should be known that each of them includes a bit formed on a free end thereof and a plurality of teeth formed on a free edge of the bit.

Figure 2:
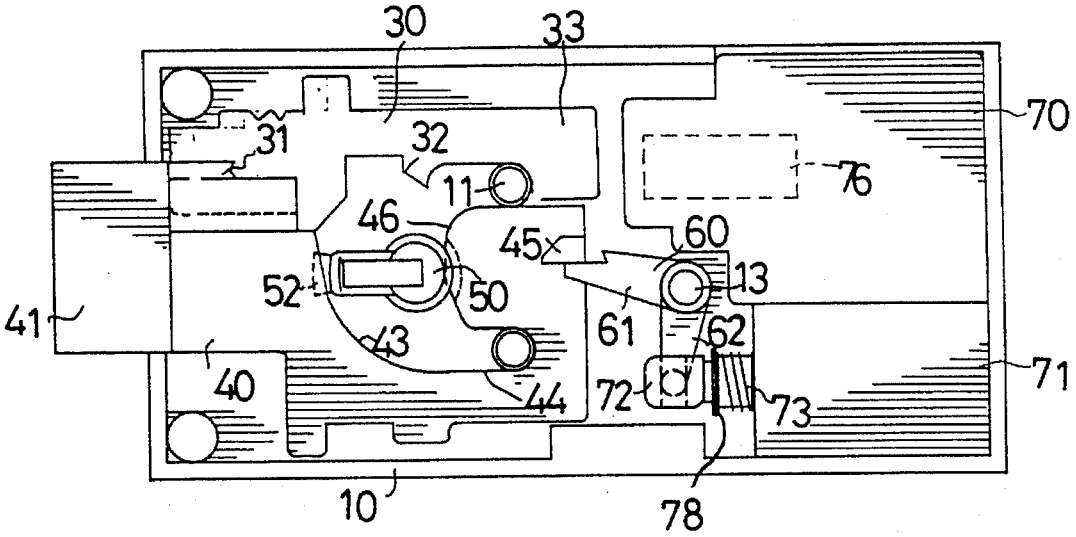
FIG. 2 is a front view of the preferred embodiment as shown in FIG. 1 with a cover removed for showing elements received in a case, a group of first key-engaging strips and a group of second key-engaging strips removed for clearness.

FIG. 2 shows a formal position of the link 52 and the third latch 30 with the key-engaging strips 80 and 85 removed for clearness. Normally, the lever-driving device is turned off. The slots 83 are not aligned with one another so that the blade 31 is not insertable into the slots 83, i.e., the third latch 30 is restrained by means of the first key-engaging strips 80. Thus, the lever-driving device remains turned off.

Figure 3:
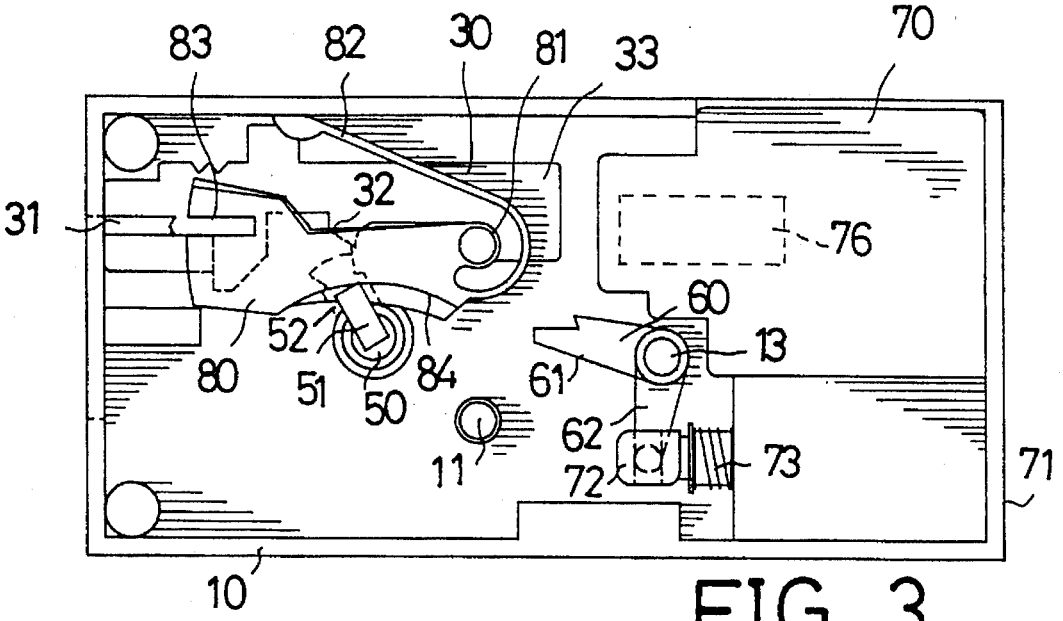
FIG. 3 is a front view of the preferred embodiment as shown in FIG. 2 with some of the elements removed for showing the group of first key-engaging strips for cooperating with a renter's key.
Figure 4:
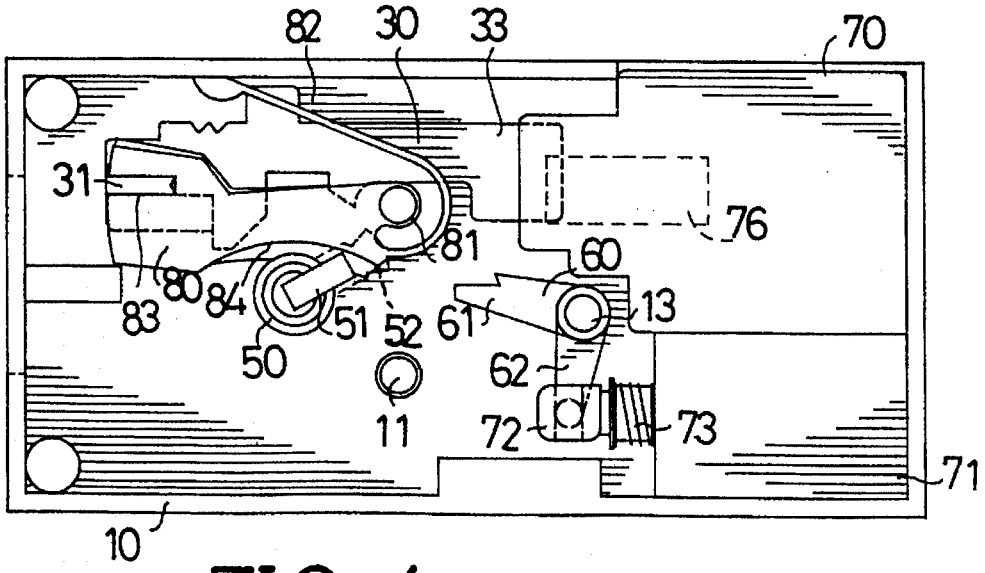
FIG. 4 is a similar view to FIG. 3 but showing the group of first key-engaging strips pivoted to a second position.

Referring to FIG. 3, the renter's key is insertable through the keyhole 18 into the groove 51. The teeth of the renter's key are engageable with the arched edges 84. When the key is pivoted clockwise, teeth of the renter's key are moved against the arched edges 84 so that the first key-engaging strips 80 are pivoted clockwise. The teeth of the renter's key differ in height so that the first key-engaging strips 80 are pivoted to various positions. The slots 83 are so located that they are aligned with one another when the first key-engaging strips 80 are pivoted to a specific combination of positions as the renter's key is pivoted to a specific position. The slots 83 are aligned with one another after the first key-engaging strips 80 are pivoted to the specific combination of positions (see FIG. 4).

The link 52 is pivoted clockwise when the renter's key is pivoted clockwise. The link 52 is engaged with the trigger-like element 32 when the slots 83 are aligned with one another. Hereinafter, when the renter's key is pivoted, the third latch 30 is moved by means of the link 52 because of the engagement of the trigger-like element 32 with the link 52.

Figure 5:
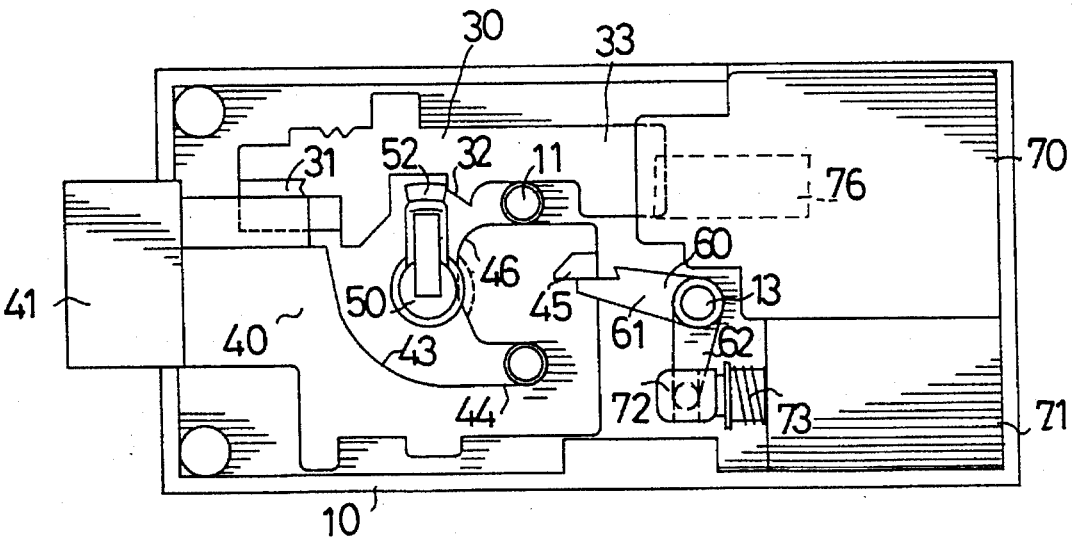
FIG. 5 is a similar view to FIG. 2 but showing a link engaged with a trigger-like element transversely projecting from a third latch for driving the third latch for pressing a microswitch.

FIG. 5 shows a second position of the link 52 and the third latch 30 with the first key-engaging strips 80 removed for clearness thereof.

When the renter's key (together with the link 52) is pivoted by 90°, the third latch 30 is moved position so that the pushing end 33 thereof pushes the microswitch 76. The lever-driving device is thus turned on, i.e., a code can be input to the control unit 70 through the keypad 75 in order to actuate the electromagnetic valve 71. When the electromagnetic valve 71 is not actuated, the free end of the mandrel 72 is moved from the electromagnetic valve 71 by means of the spring 73 through the flange 78, thus pivoting the arm 62 of the angled lever 60 clockwise so that the free end of the arm 61 of the angled lever 60 is moved to an upper position for restraining the tab 45.

The link 52 will be disengaged from the trigger-like element 32 as the link 52 is further pivoted clockwise from the position shown in FIG. 5. The link 52 will be engaged with the curved edge 46 if the link 52 is further pivoted clockwise. The second latch 40 is moved towards the right-hand side by pivoting the renter's key clockwise because of the engagement of the link 52 with the curved edge 46.

However, the second latch 40 will not be moved towards the right-hand side because the tab 45 is restrained by means of arm 61 of the angled lever 60 if no code has been accepted by the control unit.

Figure 6:
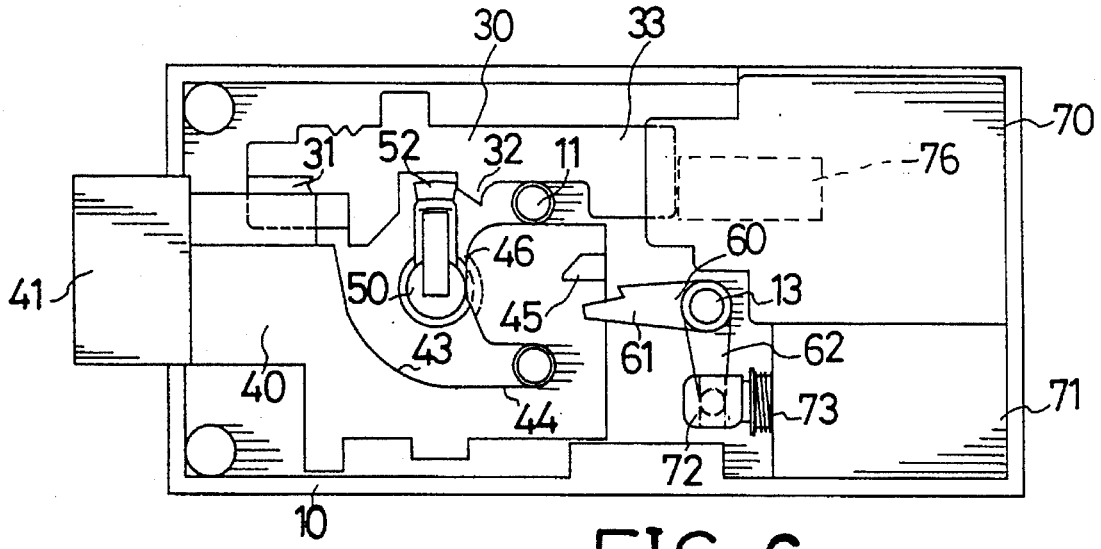
FIG. 6 is a similar view to FIG. 5 but showing an angled lever pivoted to a second position for releasing a tab projecting from a second latch.

Referring to FIG. 6, if a code has been accepted by the control unit 70, the electromagnetic valve 71 is actuated by the control unit 70 in order to retract the mandrel 72, thus pivoting the arm 62 of the angled lever 60 counterclockwise so that the free end of the arm 61 of the angled lever 60 is moved to a lower position for releasing the tab 45.

Figure 7:
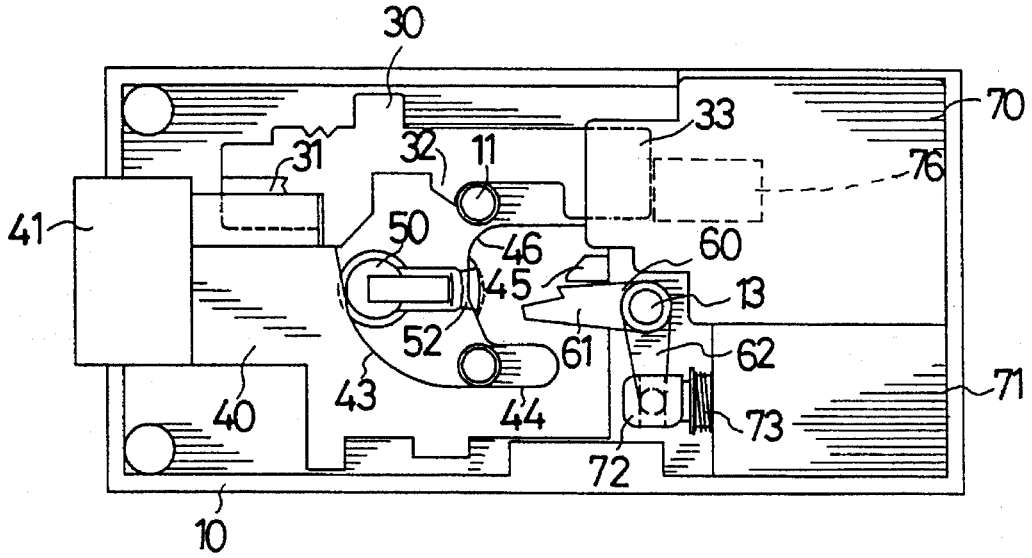
FIG. 7 is a similar view to FIG. 6 but showing a tongue substantially retracted into the case.

Referring to FIG. 7, the tongue 41 is retractable into the case 10 by further pivoting the renter's key clockwise.

FIGS. 8–12 show the co-operation between the official's key and the lock according to this invention. The official's key is useful in releasing the tab 45 from the free end of the arm 61 of the angled lever 60 when the electricity supply fails or the code is forgotten. The official's key is useful in turning off the lever-driving device when the renter fails to pay the rent.

Figure 8:
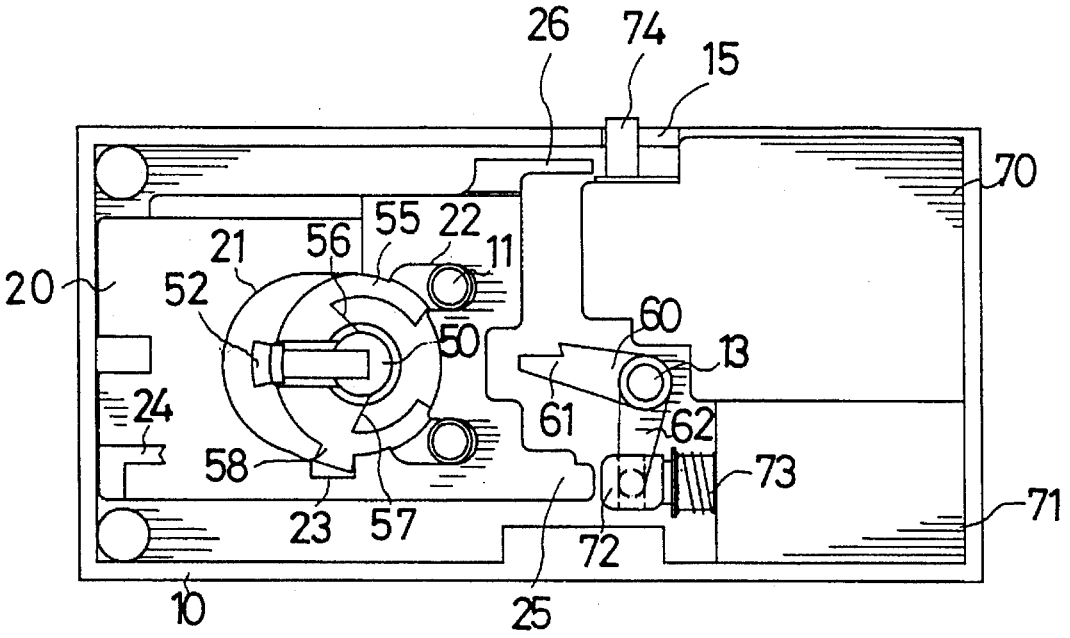
FIG. 8 is a front view of the preferred embodiment as shown in FIG. 1 with a cover and some elements removed for showing a first latch.

FIG. 8 shows the first latch 20 in a normal position. The official's key is insertable through the keyhole 18 into the groove 51. The link 52 will be pivoted counterclockwise if the official's key is pivoted counterclockwise.

Figure 9:
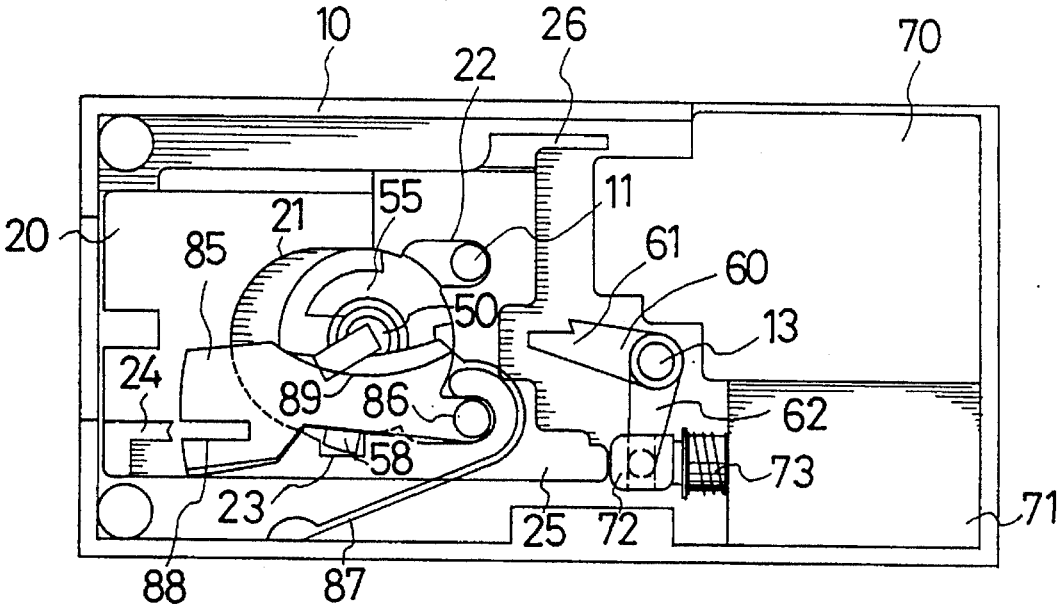
FIG. 9 is a front view of the preferred embodiment as shown in FIG. 1 with a cover and some elements removed for showing a group of second key-engaging strips for cooperating with an official's key.
Figure 10:
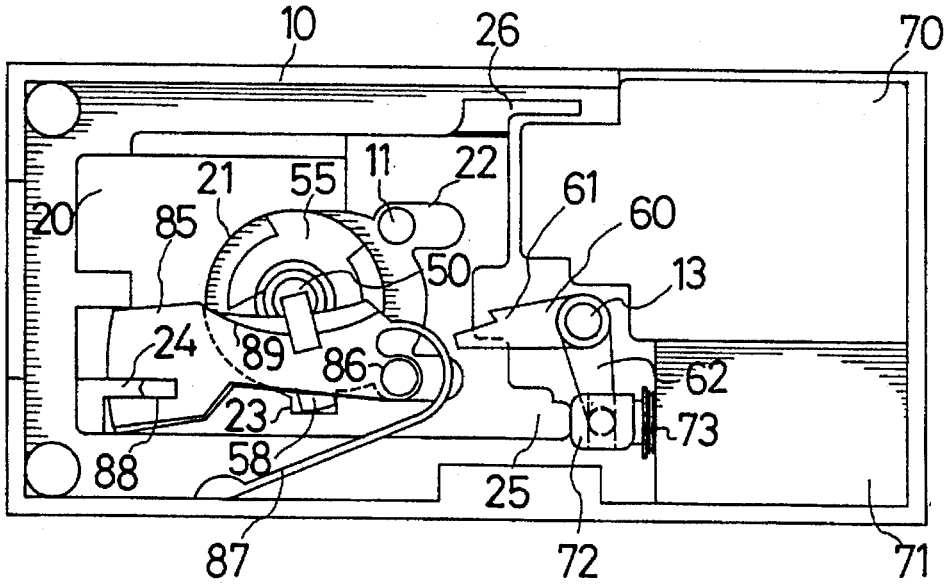
FIG. 10 is a similar view to FIG. 9 but shows the second key-engaging strips pivoted to a second position.

Referring to FIG. 9, the teeth of the official's key will be engaged with the arched edges 89 if the official's key is pivoted counterclockwise. The second key-engaging strips 85 are pivoted counterclockwise by means of the official's key because of the engagement of the arched edges 89 with the teeth of the official's key when the official's key is pivoted counterclockwise. The slots 88 are aligned with one another when the second key-engaging strips 85 are pivoted to a specific combination of positions as the official's key is pivoted by 90°. The slots 88 are aligned with one another as the official's key is further pivoted counterclockwise. The blade 24 is insertable into the slots 88 as the slots 88 are aligned with one another, thus allowing movement of the first latch 20 to the right-hand side.

Figure 11:
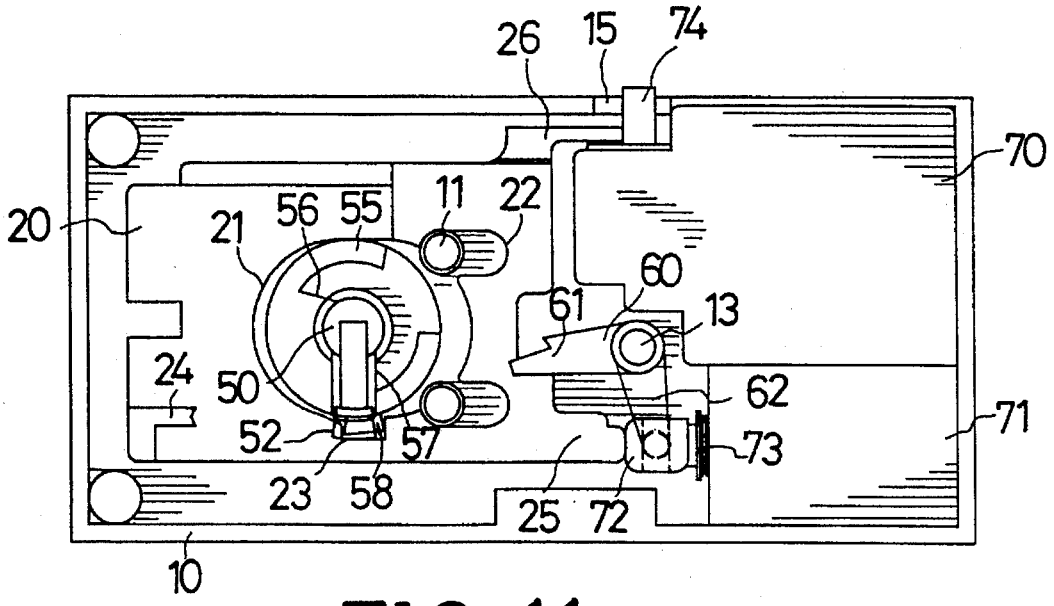
FIG. 11 is a similar view to FIG. 8 but shows a switch bar moved to an OFF position by means of a tab projecting from the first latch.

Referring to FIG. 11, if the link 52 is further pivoted counterclockwise, the boss 53 will be engaged with the shoulder 57 for pivoting the ring 55 counterclockwise. The first latch 20 will be moved to the right-hand side because of the engagement of the tab 58 with the recess 23 if the ring 55 is pivoted counterclockwise.

As the first latch 20 is moved to the right-hand side, the mandrel-pushing element 25 is moved to the right-hand side so as to move the free end of the mandrel 72 towards the electromagnetic valve 71, thus pivoting the angled lever 60 counterclockwise for releasing the tab 45 from the free end of the first arm 61 of the angled lever 60.

As the first latch 20 is moved to the right-hand side, the tab 26 is moved to the right-hand side so as to move the switch bar 74 to the right-hand side, thus turning off the control circuit.

In case that the electricity is interrupted or the renter forgets the code, the official's key should be returned to the normal position for retaining the tab 45 from the free end of the arm 61 of the angled lever 60. When the official's key is returned to the normal position, the first latch 20 is not moved to the left-hand side by means of the tab 58 projecting from the ring 55 as the shoulder 56 formed on the ring 55 is not engaged with the boss 53. The official's key is pulled from the groove 51 for allowing the renter's key to be inserted into the groove 51. The renter's key can pivoted clockwise in order to retract the tongue 41 into the case 10.

Figure 12:
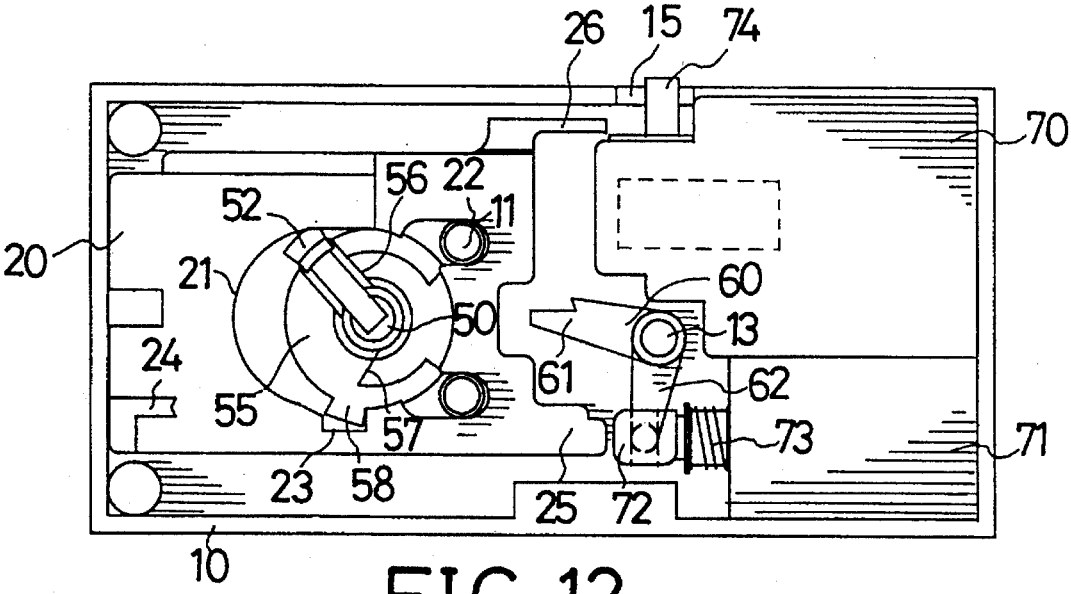
FIG. 12 is a similar view to FIG. 8.

In case that the renter fails to pay the rent, the arm 52 should be pivoted from the position shown in FIG. 11 to the position shown in FIG. 12 by pivoting the official's key clockwise for deactivating the lock. The boss 53 is engaged with the shoulder 56 formed on the ring 55 so that the first latch 20 is moved to the left-hand side by means of the tab 58 of the ring 55 so as to release the mandrel 72 from the mandrel-pushing element 25. Thus, the tab 45 will be restrained by means of the free end of the arm 61 of the angled lever 60 if the renter is trying with the renter's key to retract the tongue 41 into the case 10.

What is claimed is:

1. A lock comprising:

a case defining an aperture and a slot;

a first latch including a tab projecting therefrom, a mandrel-pushing element projecting therefrom, an aperture defined therein and a recess defined therein, wherein the first latch is slidably receivable in the case;

a ring including a lower shoulder formed thereon, an upper shoulder formed thereon and a tab formed on an edge, wherein the ring is pivotably receivable in the aperture defined in the first latch while the tab formed on the ring is receivable in the recess defined in the first latch;

a third latch including a trigger-shaped element projecting therefrom, wherein the third latch is slidably receivable in the case;

a second latch including a tongue projecting therefrom, a tab projecting therefrom, a cutout defined therein, thus forming an arched edge and a curved edge, wherein the second latch is slidably receivable in the case while the tongue is insertable through the aperture defined in the case;

a lever including a first end and a second end, wherein the lever is pivotably receivable in the case;

an electromagnetic valve including a mandrel projecting therefrom, wherein the electromagnetic valve is receivable in the case while the mandrel is linked to the second end of the lever;

a control unit including a microswitch, a switch bar and a keypad operatively linked thereto, wherein the control unit is operatively connected with the electromagnetic valve while the switch bar is insertable through the slot defined in the case;

a latch-driving element including an axle insertable through the ring, a link projecting from the axle and a dialing element projecting from the link;

whereby a renter's key is engageable with the latch-driving element and rotatable clockwise for engaging the link with the trigger-like element for driving the third latch for pressing the microswitch for actuating the control unit;

whereby after the control unit is actuated, a code can be input through the keypad to the control unit for driving the electromagnetic valve for retracting the mandrel into the electromagnetic valve for pivoting the lever, thus disengaging the first end of the lever from the tab formed on the third latch;

whereby after the tab of the third latch is released from the first end of the lever the link is further pivotable by means of the renter's key for engaging with the curved edge for retracting the tongue into the case;

whereby a clerk's key is engageable with the latch-driving element and pivotable counterclockwise for engaging the dialing element with the lower shoulder for pivoting the ring for driving the first latch because of the engagement of the tab formed on the ring with the recess defined in the first latch, so that the control unit is turned off as the switch bar is moved by means of the tab projecting from the first latch and that the tab projecting from the second latch is released from the first end of the lever as the lever is pivoted by means of the mandrel pushed by means of the mandrel-pushing element.

2. A lock in accordance with claim 1 wherein the clerk's key is pivotable clockwise for engaging the dialing element with the upper shoulder formed on the ring for pivoting the ring for driving the first latch for releasing the mandrel from the mandrel-pushing element in case that a renter fails to pay rent for a safe-deposit box on which the lock is mounted.

3. A lock according to claim 1 wherein the latch-driving element defines a groove in the axle and the link, whereby a key is receivable in the groove defined therein.

4. A lock according to claim 1 wherein the case includes an upper shaft projecting from a panel thereof, a lower shaft projecting from the panel thereof, wherein the first latch defines an upper slot and a lower slot, whereby the upper shaft formed on the case is insertable through the upper slot defined in the first latch and the lower shaft formed on the case is insertable through the lower slot defined in the first latch, so that the first latch is slidably receivable in the case.

5. A lock according to claim 4 wherein the first latch includes a blade projecting therefrom, wherein the second latch defines a slot, whereby the second latch is mounted on the blade projecting from the first latch and the lower shaft projecting formed on the case is insertable through the slot defined in the second latch, so that the second latch is slidably received in the case.

6. A lock according to claim 5 including a lower group of key-engaging strips each including an arched upper edge and defining a slot, wherein the lower group of key-engaging strips are pivotably received in the case, whereby teeth of a clerk's key are engageable with the upper edges of the lower group of key-engaging strips for aligning the slots defined in the lower group of key-engaging strips with one another for receiving the blade projecting from the first latch for allowing the movement of the first latch.

7. A lock according to claim 6 wherein the lower group of key-engaging strips each define an aperture through which the lower shaft is insertable thus pivotably mounting the lower group of key-engaging strips on the lower shaft.

8. A lock according to claim 4 wherein the third latch includes a blade projecting therefrom, whereby the blade projecting from the third latch is mounted on the second latch and the third latch is mounted on the upper shaft formed on the case.

9. A lock according to claim 8 including an upper group of key-engaging strips each including an arched lower edge and defining a slot, wherein the upper group of key-engaging strips are pivotably received in the case, whereby teeth of a renter's key are engageable with the lower edges of the upper group of key-engaging strips for aligning the slots defined in the upper group of key-engaging strips with one another for receiving the blade projecting from the third latch for allowing the movement of the third latch.

10. A lock according to claim 9 wherein the upper group of key-engaging strips each define an aperture through which the upper shaft is insertable thus pivotably mounting the upper group of key-engaging strips on the upper shaft.

11. A lock according to claim 1 wherein the case includes a hub-shaped element formed on a panel thereof, whereby the axle is insertable in the hub-shaped element.

12. A lock comprising:

a case defining an aperture and a slot;

a first latch including a blade projecting therefrom, a tab projecting therefrom, a mandrel-pushing element projecting therefrom, an aperture defined therein and a recess defined therein, wherein the first latch is slidably receivable in the case;

a ring including a lower shoulder formed thereon, an upper shoulder formed thereon and a tab formed on an edge, wherein the ring is pivotably receivable in the aperture defined in the first latch while the tab formed on the ring is receivable in the recess defined in the first latch;

a third latch including a blade projecting therefrom and a trigger-shaped element projecting therefrom, wherein the third latch is slidably receivable in the case;

a second latch including a tongue projecting therefrom, a tab projecting therefrom, a cutout defined therein, thus forming an arched edge and a curved edge, wherein the second latch is slidably receivable in the case while the tongue is insertable through the aperture defined in the case;

a lever including a first end and a second end, wherein the lever is pivotably receivable in the case;

an electromagnetic valve including a mandrel projecting therefrom, wherein the electromagnetic valve is receivable in the case while the mandrel is linked to the second end of the lever;

a control unit including a microswitch, a switch bar and a keypad operatively linked thereto, wherein the control unit is operatively connected with the electromagnetic valve while the switch bar is insertable through the slot defined in the case;

a latch-driving element including an axle insertable through the ring, a link projecting from the axle and a dialing element projecting from the link;

an upper group of key-engaging strips each including an arched lower edge and defining a slot, wherein the upper group of key-engaging strips are pivotably received in the case; and a lower group of key-engaging strips each including an arched upper edge and defining a slot, wherein the lower group of key-engaging strips are pivotably received in the case;

whereby teeth of a renter's key are engageable with the arched lower edges of the upper group of key-engaging strips for aligning the slots defined in the upper group of key-engaging strips with one another for receiving the blade projecting from the third latch for allowing the movement of the third latch;

whereby the renter's key is engageable with the latch-driving element and rotatable clockwise for engaging the link with the trigger-like element for driving the third latch for pressing the microswitch for actuating the control unit;

whereby after the control unit is actuated, a code can be input through the keypad to the control unit for driving the electromagnetic valve for retracting the mandrel into the electromagnetic valve for pivoting the lever, thus disengaging the first end of the lever from the tab formed on the third latch;

whereby after the tab of the third latch is released from the first end of the lever the link is further pivotable by means of the renter's key for engaging with the curved edge for retracting the tongue into the case;

whereby teeth of a clerk's key are engageable with the arched upper edges of the lower group of key-engaging strips for aligning the slots defined in the lower group of key-engaging strips with one another for receiving the blade projecting from the first latch for allowing the movement of the first latch;

whereby the clerk's key is engageable with the latch-driving element and pivotable counterclockwise for engaging the dialing element with the lower shoulder for pivoting the ring for driving the first latch because of the engagement of the tab formed on the ring with the recess defined in the first latch, so that the control unit is turned off as the switch bar is moved by means of the tab projecting from the first latch and that the tab projecting from the second latch is released from the first end of the lever as the lever is pivoted by means of the mandrel pushed by means of the mandrel-pushing element.

13. A lock in accordance with claim 12 wherein the clerk's key is pivotable clockwise for engaging the dialing element with the upper shoulder formed on the ring for pivoting the ring for driving the first latch for releasing the mandrel from the mandrel-pushing element in case that a renter fails to pay rent for a safe-deposit box on which the lock is mounted.

14. A lock according to claim 12 wherein the latch-driving element defines a groove in the axle and the link, whereby a key is receivable in the groove defined therein.

15. A lock according to claim 12 wherein the case includes an upper shaft projecting from a panel thereof, a lower shaft projecting from the panel thereof, wherein the first latch defines an upper slot and a lower slot, whereby the upper shaft formed on the case is insertable through the upper slot defined in the first latch and the lower shaft formed on the case is insertable through the lower slot defined in the first latch, so that the first latch is slidably receivable in the case.

16. A lock according to claim 15 wherein the upper group of key-engaging strips each define an aperture through which the upper shaft is insertable thus pivotably mounting the upper group of key-engaging strips on the upper shaft.

17. A lock according to claim 15 wherein the lower group of key-engaging strips each define an aperture through which the lower shaft is insertable thus pivotably mounting the lower group of key-engaging strips on the lower shaft.

18. A lock according to claim 12 wherein the first latch includes a blade projecting therefrom, wherein the second latch defines a slot, whereby the second latch is mounted on the blade projecting from the first latch and the lower shaft projecting formed on the case is insertable through the slot defined in the second latch, so that the second latch is slidably received in the case.

19. A lock according to claim 12 whereby the blade projecting from the third latch is mounted on the second latch and the third latch is mounted on the upper shaft formed on the case.

20. A lock according to claim 1 wherein the case includes a hub-shaped element formed on a panel thereof, whereby the axle is insertable in the hub-shaped element.

* * * * *